US005442594A

United States Patent [19]

Cray

[11] Patent Number: 5,442,594

[45] Date of Patent: Aug. 15, 1995

[54] RIB STIFFENED SOUND WAVE PROJECTOR PLATE

[75] Inventor: Benjamin A. Cray, Richmond, R.I.

[73] Assignee: The United States of America as represented by the Secretary of the Navy, Washington, D.C.

[21] Appl. No.: 306,555

[22] Filed: Sep. 14, 1994

[51] Int. Cl.[6] ..... H04R 1/00

[52] U.S. Cl. ..... 367/162; 367/165; 367/176

[58] Field of Search ..... 181/142, 402; 367/176, 367/152, 162, 165

[56] References Cited

U.S. PATENT DOCUMENTS

| | | | |
|---|---|---|---|
| 2,484,626 | 10/1949 | Keller | 367/162 |
| 3,605,080 | 9/1971 | Abbott | 340/12 |
| 3,983,425 | 9/1976 | Barlow | 340/10 |
| 3,990,034 | 11/1976 | Abbott | 340/7 R |
| 4,704,556 | 11/1987 | Kay | 367/165 |
| 5,233,570 | 8/1993 | Donskoy | 367/176 |
| 5,239,518 | 8/1993 | Kazmar | 367/157 |
| 5,335,209 | 8/1994 | Jaenke et al. | 367/176 |

FOREIGN PATENT DOCUMENTS

| | | | |
|---|---|---|---|
| 0095795 | 6/1982 | Japan | 367/176 |

*Primary Examiner*—Charles T. Jordan
*Assistant Examiner*—Theresa M. Wesson
*Attorney, Agent, or Firm*—Michael J. McGowan; Prithvi C. Lall; Michael F. Oglo

[57] ABSTRACT

A rib-stiffened sound wave projector plate is disclosed which generates low frequency sound waves in a fluid medium when energized and flexed. A flexible sound wave projector plate includes at least first and second parallel, major planar surfaces. The first major planar surface includes at least one set of sound wave projector plate ribs, disposed perpendicular to the first major planar surface. Each set of sound wave projector plate ribs includes at least first and second sound wave projector plate rib set members. Each member of the rib sets are offset or spaced laterally from one another by a first predetermined distance, while the first rib member of each rib set is spaced apart a second predetermined distance which is greater than the first distance between the rib set members. Further, each rib set member has a predetermined height and width which may vary from other rib set members in each rib set.

11 Claims, 2 Drawing Sheets

RIB STIFFENED SOUND WAVE PROJECTOR PLATE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates to sound wave projectors and more particularly, to a sound wave projector which repeatedly generates low frequency sound waves in a fluid medium such as utilized in Sound Navigation and Ranging (SONAR).

(2) Description of the Prior Art

Sound navigation and ranging (sonar) has long been utilized by underwater vessels for both navigation and detection.

Sonar utilizes sound waves which are propagated through the water and reflected back by the object(s) of interest which the sound waves strike. Sonar systems are most efficient when they rely on the generation of low frequency (less than 1,000 hertz) sound waves.

In the past, repeatedly generating low frequency sound waves in a fluid medium has proved difficult and expensive, requiring large sound projector mechanisms which are costly and include many moving parts to repair and replace. An example of such prior art systems include mechanical pistons which move water within a baffle. These devices tend to be very large in order to generate the requisite low frequency sound waves.

Additional prior art systems include piezoelectric or electromechanical transducers which vibrate in order to generate sound waves. These devices are also unreliable and do not effectively or efficiently produce the necessary low frequency sound waves.

Accordingly, what is required is an acoustical, sound wave projector which is nominally sized for repeatedly producing low frequency sound waves in a coupled fluid medium.

SUMMARY OF THE INVENTION

The present invention features a rib stiffened, sound wave projector plate which generates low frequency sound waves in a fluid medium when the plate is energized and flexed.

The rib stiffened sound wave projector plate is comprised of a flexible material and includes at least first and second parallel, major planar surfaces.

The first major planar surface of the rib stiffened, flexible, sound wave projector plate includes at least one set of sound wave projector plate ribs. The sound wave projector plate ribs are attached to the first major planar surface perpendicular to the surface. Each set of sound wave projector plate ribs includes at least first and second sound wave projector plate rib set members. The rib set members serve to stiffen and alter the flexing of the sound wave projector plate when energized by a source such as an electromotive force, which is applied normal or perpendicular to the first and second major planar surfaces of the sound wave projector plate.

In the preferred embodiment, the rib stiffened, sound wave projector plate includes at least first and second sets of sound wave projector plate ribs on the first major planar surface. Further, each set of sound wave projector plate ribs includes at least first and second sound wave projector plate rib set members. Each sound wave projector plate rib set member includes a predetermined width and height. In one embodiment, each sound wave projector plate rib set member includes at least one height or width measurement which is not equal to at least one of a corresponding width and height of at least one other sound wave projector plate rib member.

In the preferred embodiment, the first sound wave projector plate rib set member of each of the sets of sound wave projector plate ribs is spaced laterally from the second sound wave projector plate member of each respective set on the first major planar surface a first predetermined distance. Additionally, the first sound wave projector plate rib set member of the first set of ribs is spaced laterally from the first sound wave projector plate rib set member of the second set on the first major planar surface a second predetermined distance which is greater than the first predetermined distance between each rib set members within one rib set.

In a further embodiment, at least one of the rib sets includes at least three rib set members, wherein at least one of the rib set members includes a predetermined width and height which is not equal to a corresponding width and height of at least one of the other two sound wave projector plate rib set members. In yet another embodiment, a sound wave projector plate may be rectangular, square, circular or some other useful shape.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENT

Figure 1:
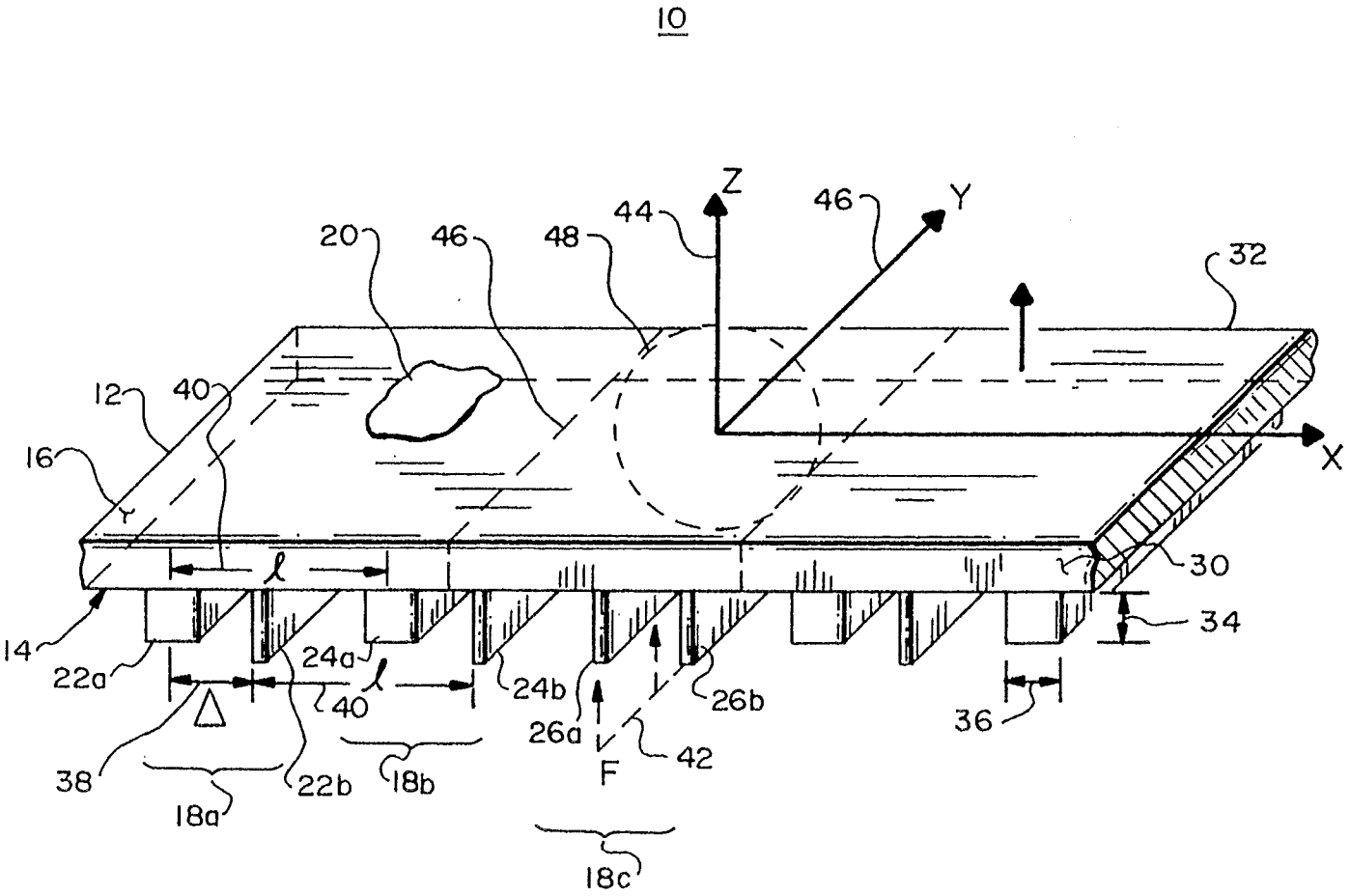
FIG. 1 is a schematic illustration of one embodiment of the rib stiffened, sound wave projector plate according to the present invention.

One embodiment of the acoustic, rib stiffened sound wave projector plate 10 FIG. 1 is illustrated which includes a flexible, sound wave projector plate 12 having at least a first major planar surface 14 parallel to a second major planar surface 16.

The present invention includes providing one or more sets of ribs 18*a*–18*c* on the first major planar surface 14 of the plate 12, which is opposite that of the second major planar surface 16 which is in contact with the fluid medium 20 such as water.

In the preferred embodiment, each rib set, such as rib set 18*a*, includes first and second rib set members 22*a*, 22*b*. Similarly, rib set 18*b* includes first and second rib set member 24*a* and 24*b*, while rib set 18*c* includes first and second rib set members 26*a* and 26*b*.

In a first embodiment, each rib set member such as rib set members 26*a*, 26*b* of rib set 18*c* are of generally the same size and shape, preferably having a cross-sectional area of 0.443 $in^2$ extending generally from one edge 30 of plate 12 to a second, opposing edge 32. In other embodiments, however, each rib set member such as rib set members 22*a*, 22*b* and 24*a*, 24*b* may include a predetermined height included generally by arrow 34 and predetermined width indicated generally by arrow 36 which differs from one rib set member to the other.

In the preferred embodiment, the first and second rib set members such as 22a and 22b are separated a first predetermined distance indicated generally by arrow 38, while each first rib set member such as rib set members 22a and 24a, or each second rib set member such as rib set members 22b and 24b are separated laterally, across the surface 14 of plate 12 a second predetermined distance indicated generally by arrow 40. The second predetermined distance "l" is greater than the first predetermined distance "Δ". Exemplary spacings are represented by an inter rib set member spacing 38 of approximately two inches, and a periodic rib set spacing ("l" arrow 40) of approximately 24 inches. These exemplary dimensions are given for a plate 12 having a length of ten feet, a width five feet and a thickness of approximately 0.25 inches. Further, the plate 12 may be constructed of any flexible material, such as steel, having a Young's Modulus of $27.7\times10^6$ p.s.i. (per square inch), a modulus loss factor of 0.02, a combined mass density of plate and rib-stiffeners of 475 lb/ft$^3$, and a Poisson's ratio of 0.28.

An excitation or energizing source (not shown) such as an electromotive force, which is well known to those skilled in the art, is applied to plate 12 parallel to the Z axis, as indicated generally by force lines 42. Applying a 1,000 Newton excitation force indicated generally by arrow 42 in a direction parallel to the Z axis 44 along a line parallel to the Y axis 46 yields a 1,000 hertz sound wave having a 190 db amplitude signal measured at one meter from the face 16 of the sound wave projector plate 12.

The analytical expression which yields the far-field acoustic radiation generated by vibration or flexing of the surface 16 of the rib-stiffened sound wave projector plate 12 is given by the following formula:

$$P(R,\theta) \sim -\frac{\rho_0\omega^2\widetilde{w}(\widetilde{k})}{2\sqrt{Rk_0\pi}}\, e^{iRk_0(1+i)} \tag{1}$$

wherein:

$k=k_o \sin\theta$ point of stationary phase,
R, $\theta$ polar coordinates,
$\omega$ harmonic angular frequency,
$\pi$ circumference of circle divided by its diameter, $=3.14\ldots$,
$k_0$ acoustic wavenumber, $=\omega/C_0$
$C_0$ acoustic phase velocity in the fluid medium,
$\rho_0$ mass density of acoustic fluid,
i positive square root of $-1$,
W(k) wavenumber response of the fluid-loaded stiffened plate evaluated at the stationary phase value.

For two sets of rib-stiffeners, one set of rib-stiffeners offset from the other by the amount Δ, the wavenumber or spectral response for a line force excitation is:

$$\widetilde{W}(k)=F(k)-Y(k)\,x$$

$$\left\{\frac{K_2(1+K_1Y_0(k)F_1(k)+K_1(1+K_2Y_0(k))F_0(k)-K_1K_2(F_0(k)Y_1(k)+F_1(k)Y_{-1}(k))}{1+(K_1+K_2)Y_0(k)+K_1K_2(Y_o^2((k)-Y_1(k)Y_{-1}(k)}\right\} \tag{2}$$

wherein:

$$F_p(k)=\sum_{n=-\infty}^{\infty} F(k+nk_l)\,e^{ik_1n\Delta p}\quad p=0,1 \tag{3}$$

$$Y_p(k)=\sum_{n=-\infty}^{\infty} Y(k+nk_l)\,e^{ik_ln\Delta p}\quad p=-1,0,1 \tag{4}$$

$$F(k)=\frac{F_0e^{-ikx_0}}{S(k)}, \tag{5}$$

$$S(k)=\begin{cases} D(k^4-k_b^4)-\dfrac{ip_0\omega^2}{\sqrt{k_{p0}^2-k^2}} & |k|\leqq k_0 \\ D(k^4-k_b^4)-\dfrac{p_0\omega^2}{\sqrt{k^2-k_0^2}} & |k|\geqq k_0 \end{cases} \tag{6}$$

k wavenumber in the direction along the plate's surface perpendicular to the rib-stiffeners,
$K_1$=dynamic structural mass=$m_1\omega^2/l$, of first set of rib-stiffeners.
$K_2$=dynamic structural mass=$m_2\omega^2/l$, of second set of rib-stiffeners.
$k_1$=wavenumber associated with periodic rib spacing, $=2\pi/l$,
$k_b$free wavenumber of the plate in vacuo, $=(m\omega^2/D)^{\frac{1}{4}}$, $$D \text{ isotropic plate flexural rigidity, } = \frac{1}{12}\ \frac{Eh^3}{(1-\nu^2)},$$

$m_1'$ mass per unit area of the plate,
$m_2'$ mass per unit length of the second set or rib-stiffeners,
E elastic modulus of the plate material,
$\nu^2$ Poisson's ratio for the plate material,
h thickness of the plate,
l periodic inter rib spacing between any given set of rib-stiffeners,
Δ offset of one set of rib-stiffeners to another set,
e base of the Napierian logarithm, =2,718 . . . ,
$X_0$ point of application of line force,
$F_0$ magnitude of applied line force,
$\rho_s$ mass density of plate and rib-stiffeners (steel),
$\eta$ Young's modulus loss factor.

Although sound wave projector plate 12 is illustrated for exemplary purposes as a rectangular plate, it is considered within the scope of the invention to utilize a square plate as indicated generally by dashed line 46, or a circular plate indicated generally by dashed line 48. Additionally, other shapes may be developed after further experimentation based upon such factors as the frequency and/or amplitude or intensity of the sound wave desired to be generated. Modifications and/or substitutions by one of ordinary skill in the prior art are to considered to be within the scope of the present invention.

Figure 2:
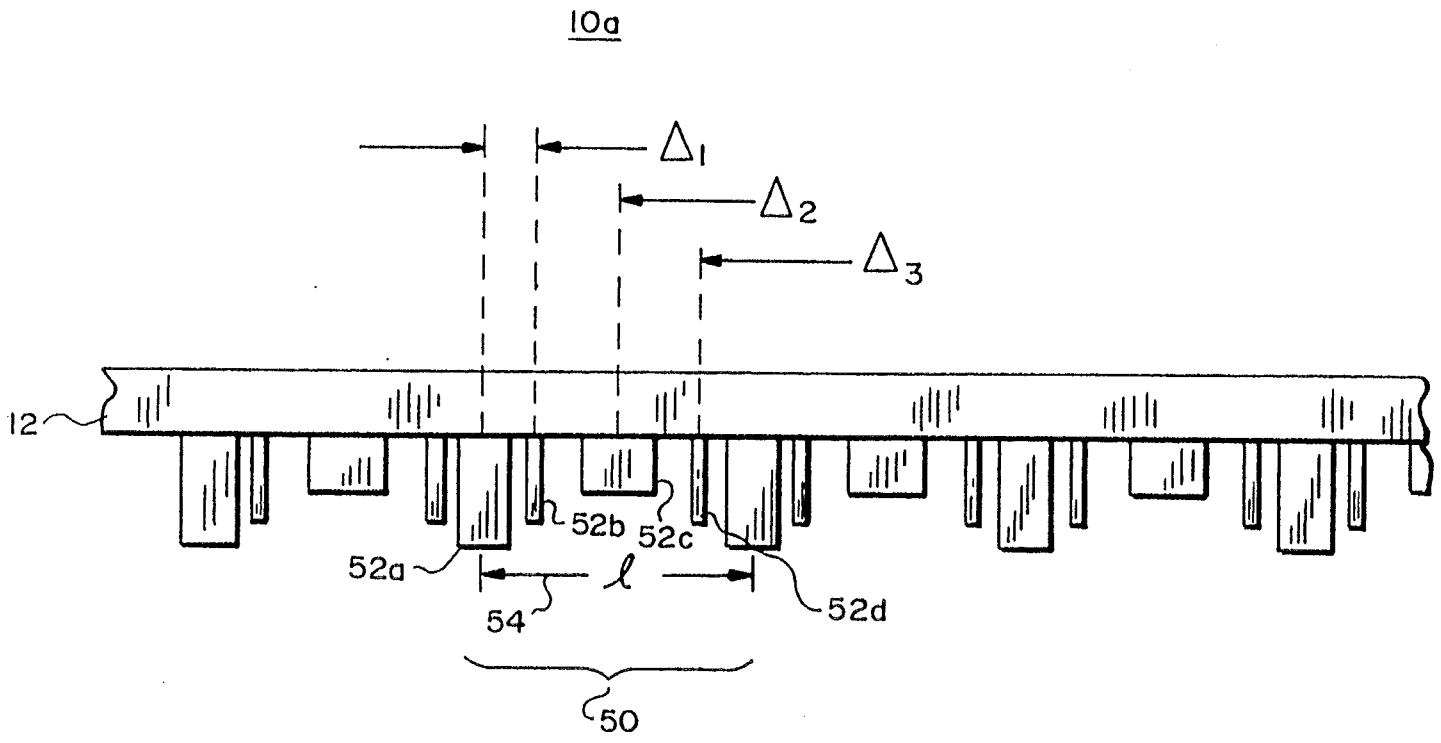
FIG. 2 is a side view schematic illustration of another embodiment of the rib stiffened, sound wave projector plate of the present invention.

In an alternative embodiment of the rib-stiffened sound wave projector plate 10a, FIG. 2, the sound wave projector plate 12 includes one or more sets of sound wave projector plate ribs 50 including four rib set members 52a, 52b, 52c and 52d. In this embodiment, each set of rib-stiffeners is separated by the distance l shown generally by arrow 54. Additionally, this embodiment contemplates that two or more sound wave projector plate rib set members such as members 52b and 52*d* may have generally the same cross-sectional areas of preferably approximately 0.443 $in^2$ while the remaining sound wave projector plate rib set members 52*a* and 52*c* may have difference cross-sectional areas.

In light of the above, it is therefore understood that within the scope of the appended claims, the invention may be practiced otherwise than as specifically described.

What is claimed is:

1. An acoustic, rib stiffener sound wave projector plate, for generating low frequency sound waves in a fluid medium when the plate is energized and flexed, comprising:

a flexible sound projector plate having at least first and second parallel, major planar surfaces;

said first major planar surface of said flexible sound wave projector plate including at least a first set of sound wave projector plate ribs disposed perpendicular to said first major planar surface, each set of sound projector plate ribs including at least first and second rib set members;

said first sound wave projector plate rib member including first predetermined width and height wherein at least one of said first predetermined width and height is not equal to at least one of a corresponding width and height of said second sound wave projector plate rib set member; and said second major planar surface of said rib stiffened, sound wave projector plate coupled proximate said fluid medium, for generating low frequency sound waves in said fluid medium when said sound projector plate is energized and caused to flex.

2. The sound wave projector plate of claim 1 wherein said first major planar surface includes at least first and second sets of sound wave projector plate ribs.

3. The sound wave projector plate of claim 1 wherein a flexible sound projector plate having at least first and second parallel major planar surfaces;

said first major planar surface of said flexible sound projector plate including at least first and second sets of sound projector plate ribs disposed perpendicular to said first major planar surface, each of said first and second sets of sound projector plate ribs including at least first and second sound projector plate rib set members.

4. The sound wave projector plate of claim 1 wherein said sound wave projector plate is energized in a direction normal to said first and second major planar surfaces.

5. The rib stiffened sound wave projector plate of claim 4 wherein said plate is energized by means of an electromotive force.

6. The sound projector plate of claim 1 wherein said first major planar surface includes a plurality of sets of sound wave projector plate ribs.

7. The sound projector plate of claim 1 wherein said at least a first set of sound wave projector plate ribs includes at least three sound wave projector plate rib set members; and wherein at least two of said at least three sound wave projector rib set members include at least one of a predetermined width and height which is not equal to at least one of a corresponding predetermined width and height of at least one of said at least three sound wave projector plate rib set members.

8. The sound wave projector plate of claim 1 wherein said plate includes a shape selected from the group consisting of: a rectangle, a square and a circle.

9. An acoustic, rib stiffened sound wave projector plate, for generating low frequency sound waves in a fluid medium when the plate is energized and flexed, comprising:

a flexible sound projector plate having at least first and second parallel, major planar surfaces;

said first major planar surface of said flexible sound projector plate including at least first and second sets of sound projector plate ribs disposed perpendicular to said first major planar surface, each of said first and second sets of sound projector plate ribs including at least first and second sound projector plate rib set members;

said first sound projector plate rib set member of each of said at least first and second sets of sound projector plate ribs spaced laterally from said at least second sound projector plate rib set member of each set of sound projector plate ribs on said first major planar surface a first predetermined distance;

said first sound projector plate rib set member of said first set of sound projector plate ribs spaced laterally from said at least second set of sound projector plate ribs on said first major planar surface a second predetermined distance greater than said first predetermined distance; and wherein said second major planar surface of said sound wave projector plate is coupled proximate said fluid medium, for generating low frequency sound waves of a predetermined frequency in said fluid medium upon energizing and flexing said sound wave projector plate.

10. An acoustic, rib-stiffened sound wave projector plate, for generating low frequency sound waves in a fluid medium when the plate is energized and flexed, comprising:

a flexible sound wave projector plate having at least first and second parallel, major planar surfaces;

said first major planar surface of said flexible sound projector plate including at least first and second sets of sound projector plate ribs disposed perpendicular to said first major planar surface, each of said first and second sets of sound wave projector plate ribs including at least first and second sound projector plate rib set members, said first sound wave projector plate rib set member having a predetermined width and height, at least one of said predetermined width and height of said first sound wave projector plate rib set member not equal to at least one of a corresponding width and height of said second sound wave projector plate rib set member;

said first sound projector plate rib set member of each of said at least first and second sets of sound projector plate ribs spaced laterally from said at least second sound wave projector plate rib set member of each set of sound wave projector plate ribs on said first major planar surface a first predetermined distance;

said first sound wave projector plate rib set member of said first set of sound projector plate ribs spaced laterally from said at least second set of sound projector plate ribs on said first major planar surface a second predetermined distance greater than said first predetermined distance; and wherein said second major planar surface of said sound wave projector plate is coupled proximate said fluid medium, for generating low frequency sound waves of a predetermined frequency in said fluid medium upon energizing and flexing of said sound wave projector plate.

11. The sound projector plate of claim 10 wherein said first major planar surface includes a plurality of sets of sound projector plate ribs.

* * * * *